United States Patent [19]

van Heijst

[11] 4,082,050

[45] Apr. 4, 1978

[54] COUPLING BETWEEN AN ANCHOR UNDER WATER AND A BUOYANT BODY

[75] Inventor: Willem Jan van Heijst, Monte Carlo, Monaco

[73] Assignee: Single Buoy Moorings, Inc., Fribourg, Switzerland

[21] Appl. No.: 719,589

[22] Filed: Aug. 30, 1976

[51] Int. Cl.[2] ..... B63C 7/00

[52] U.S. Cl. ..... 114/53; 403/154; 9/8 R; 9/8 P; 114/294

[58] Field of Search ..... 403/154, 157, 158, 159, 403/79; 24/150 R; 29/5; 294/78 R; 59/85, 86; 9/8 R, 8 P, 9; 114/50, 51, 52, 53, 108, 111, 113–115, 294, 293, 295–310

[56] References Cited

U.S. PATENT DOCUMENTS

| | | | |
|---|---|---|---|
| 236,749 | 1/1881 | Adams | 403/157 |
| 1,367,044 | 2/1921 | Hausler | 114/51 |
| 2,422,327 | 6/1947 | Winslow | 403/158 |
| 2,747,696 | 5/1956 | Blattner | 403/154 |
| 3,209,422 | 10/1965 | Dritz | 24/150 R |
| 3,314,711 | 4/1967 | Dietz | 294/78 R |
| 3,883,912 | 5/1975 | Pedersen | 9/8 P |

FOREIGN PATENT DOCUMENTS

| | | | |
|---|---|---|---|
| 281,061 | 12/1930 | Italy | 114/53 |

*Primary Examiner*—Trygve M. Blix
*Assistant Examiner*—D. W. Keen
*Attorney, Agent, or Firm*—Young & Thompson

[57] ABSTRACT

A coupling is established between a buoyant body and a submerged anchor, by drawing down an internal bush until it is aligned between the lower ends of a pair of holes through upstanding parallel cheeks secured to the anchor. The holes have larger lower ends than upper ends. A pin is then inserted through the bush; and when the buoyant body is released, its buoyancy draws the coupling up until the pin lodges in the upper ends of the holes through the cheeks attached to the anchor.

7 Claims, 3 Drawing Figures

COUPLING BETWEEN AN ANCHOR UNDER WATER AND A BUOYANT BODY

The invention refers to a coupling with two perpendicular hinged shafts, such as a cardan joint, between an anchor fixed under water and a buoyant body. An example of such a coupling is to be found in my copending application Ser. No. 665,333, filed Mar. 9, 1976, now U.S. Pat. No. 4,031,582. In this earlier proposal the cardan joint was fixed to the anchor by means of a large footplate, using a large number of bolts. Due to its buoyancy, the body which has to be pulled towards the anchor against this upward force, makes securing a hard job.

It should be considered that a connection should withstand a lifting load of around 200 tons requiring 48 bolts, whilst the depth is 150 m, for example.

The aim of the invention is to simplify this work significantly. According to the invention, this aim is achieved because one of the hinged shafts consists of an internal bearing bush containing a fixing pin, the internal bush being mounted between two cheeks, with a space between and parallel to each other and reaching upwards from the anchor. The fixing pin is secured in the upper part of oblong holes in the cheeks, the lower part of which is bigger than the top part, containing the fixing pin, so as to allow the ends of the pin to move freely.

In order to fix the cardan joint to the anchor, care shall be taken that the joint with the internal bearing bush is in alignment with the lower part of the oblong holes. The fixing pin can then easily be pushed through and is automatically locked as soon as the body is allowed to float.

Preferably a coupling is applied, the hinged shafts of which cross each other and the internal bearing bush is located where the lower hinged shaft is situated.

Preferably the base of the coupling is provided with a connection for lifting gear, whilst the anchor is provided with a member for guiding this lifting gear. With the aid of a lifting jack fitted to the anchor, the body can be pulled against the upward force into position for making the connection.

To ensure correct positioning of the pin, the cheeks should preferably be provided, on the inside, with dished plates for holding the coupling precisely in the position where the pin is level with the lower part of oblong holes. These holes can be either oval or key-hole shaped.

The pin can be constructed in such a way that, with a head at one end, it fits in the top part of a hole, whilst a ring fits on the other end. This ring fits in the top part of the other hole and is locked by a locking plate fixed at this end, the dimensions of the plate being larger than those of the top part of the opening.

Furthermore, it is advisable to provide the pin at one end with a removable tapering end piece, which could be fitted with a lifting eye. This end part can be fitted onto or inside the pin by means of a screw thread.

The invention is elaborated further by the drawings.

Figure 1:
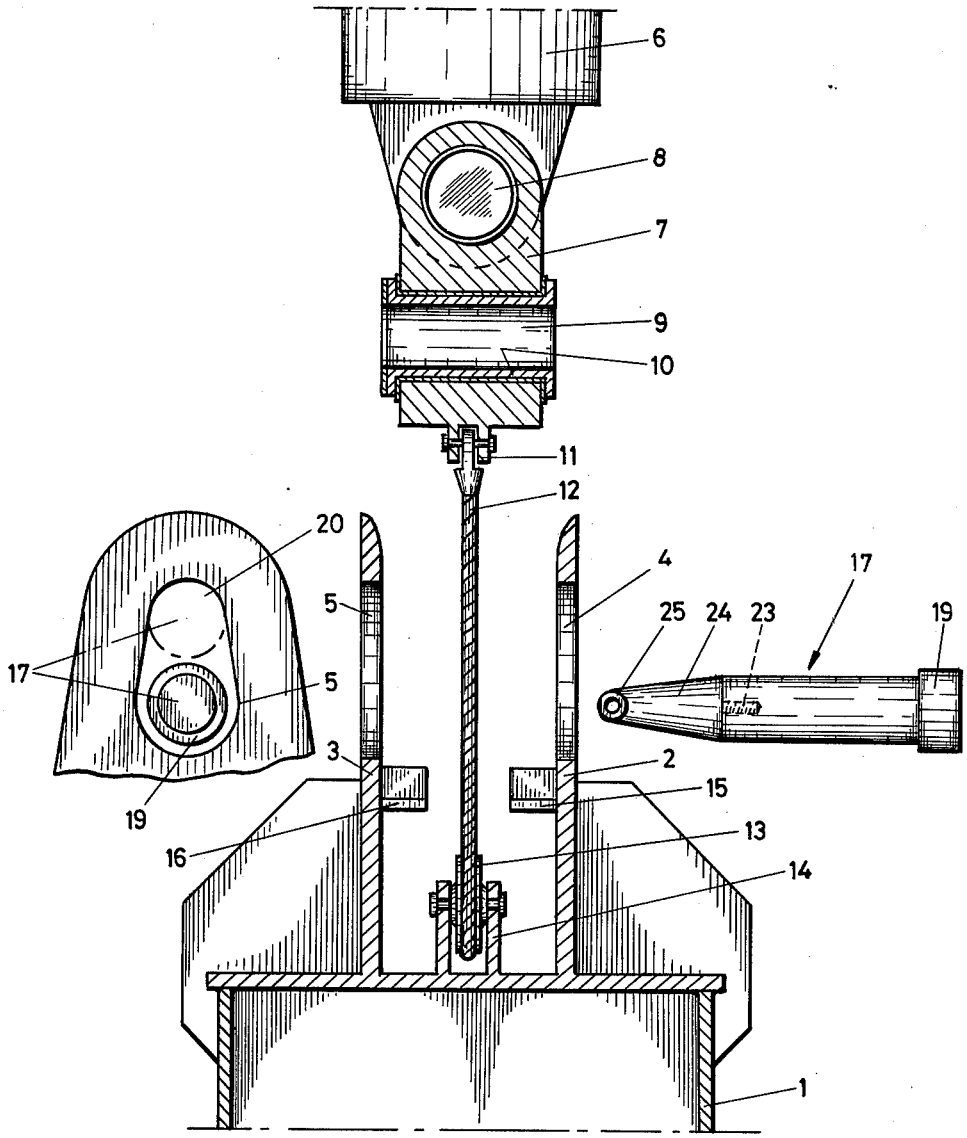
FIG. 1 shows the parts of a coupling of the invention in the position before this coupling has been completed.

The coupling shown in FIG. 1 consists of an anchor 1, the top part of which is provided with cheeks 2 and 3, having oval holes 4 and 5 respectively, as shown on the left hand side of FIG. 1.

The body 6 to be fitted is connected at the bottom end by means of a hinged shaft 8 to a cross piece 7, at the bottom of which is mounted an internal bearing bush 10, which, along with the fixing pin 17 still to be mounted, is to form shaft 9. At the bottom end of the cross piece there is an attachment 11 for a lifting gear 12, running under a pulley 13, which is carried by eyelets 14 of the base of the anchor.

The cheeks 2 and 3 respectively have dished plates 15 and 16, facing each other in which the base of the cross piece can accurately be seated.

When this cross piece, fully assembled beforehand above water, is pulled by means of the cable 12 into the position in which the cross piece rests on the dished plates 15 and 16, the pin 17 can be pushed through the holes 4 and 5 and through the internal bearing bush 10. When this has been done, a ring 18 is placed on the other end of the pin 17. Then by paying out the cable 12, the head 19 and the ring 18 can be fitted in the top part 20 of the holes 4 and 5 respectively. The coupling will then have to be secured in the axial direction of the pin and the internal bearing bush 10 can be retained by fitting the locking plate 21, which will be secured by a bolt 22 which is screwed into a threaded hole 23, in which the tapered end 24 removed earlier was fixed. This end 24 could be provided with a shackle 25 to hold the lifting gear by means of which the rather heavy pin can be handled.

Figure 2:
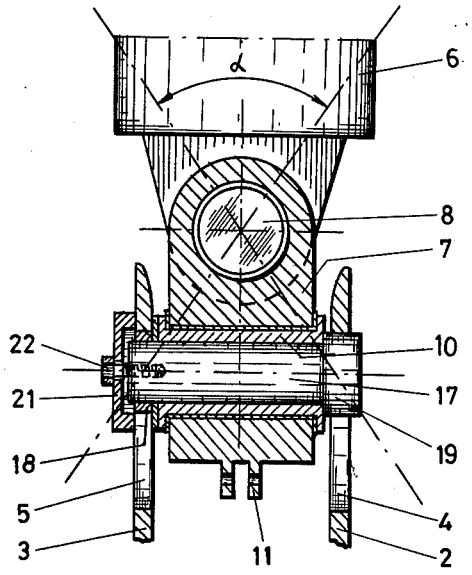
FIG. 2 shows the coupling of FIG. 1 in the assembled position.
Figure 3:
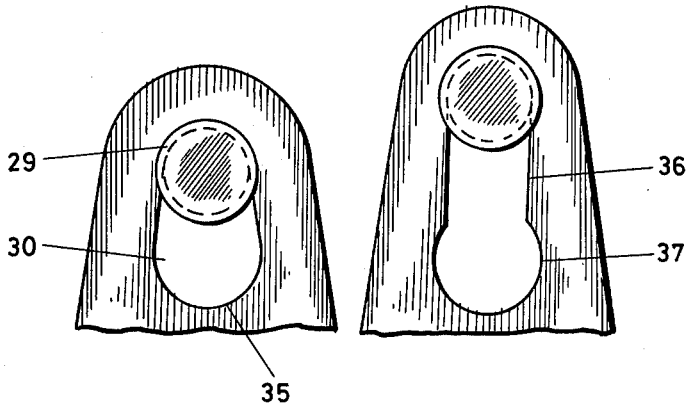
FIG. 3 shows another design of the locating hole.

FIG. 3 shows a different design of the holes in the cheeks of the anchor. This hole takes the shape of a keyhole with a small top part 36 and a large opening 37 on the lower edge. This hole can be used with a pin as shown in the FIGS. 1 and 2.

FIG. 2 shows an angle da. This angle is such that the movements of the body will remain within the angle, so that both ends of the pin 17 will always abut the upper part of the holes in the cheeks, due to the pull of the body.

What I claim is:

1. A coupling between a buoyant body and an anchor, comprising a pair of perpendicular hinged shafts, one of said shafts comprising an internal bush, the other of said shafts being disposed above said bush, a pin insertable in the bush, a pair of spaced parallel cheeks upstanding from the anchor, the pin being of a length greater than the distance between the cheeks, the cheeks having vertically elongated holes therein whose upper ends are of a size to receive the pin and whose lower ends are larger than said upper ends, and a pulley on the anchor, between said cheeks, about which a cable is reeved and secured to said one shaft for pulling said coupling downward, whereby when said bush is aligned between said lower ends of said holes, said pin is insertable in said bush, and when the upward force of said buoyant body pulls the coupling upward, said pin is pulled up into said upper ends of said holes.

2. A coupling as claimed in claim 1, in which said holes are oval in shape.

3. A coupling as claimed in claim 1, in which said holes have the shape of a keyhole.

4. A coupling as claimed in claim 1, the pin having a head and the head of the pin fitting into the upper end of one said hole, the pin having a ring on its other end that fits into the upper end of the other said hole, and a locking plate bolted to the same end of the pin as said ring, said locking plate being larger than the upper end of the adjacent said hole.

5. A coupling as claimed in claim 1, in which said pin has a removable tapered end with a lifting eye thereon.

6. A coupling between a buoyant body and an anchor, comprising an internal bush and a pin insertable in the bush, a pair of spaced parallel cheeks upstanding from the anchor, the pin being of a length greater than the distance between the cheeks, the cheeks having vertically elongated holes therein whose upper ends are of a size to receive the pin and whose lower ends are larger than said upper ends, whereby when said bush is aligned between said lower ends of said holes, said pin is insertable in said bush, and when the upward force of said buoyant body pulls the coupling upward, said pin is pulled up into said upper ends of said holes, and means on the inside of said cheeks for limiting the downward movement of said bush between said cheeks.

7. A coupling as claimed in claim 6, said limiting means comprising upwardly concave plates.

* * * * *